US009534572B2

(12) United States Patent
Mills

(10) Patent No.: US 9,534,572 B2
(45) Date of Patent: Jan. 3, 2017

(54) SINGLE AND DUAL PLENUM ADAPTER

(71) Applicant: Simon Thomas Mills, Columbus, OH (US)

(72) Inventor: Simon Thomas Mills, Columbus, OH (US)

(73) Assignee: Simon T. Mills, Columbus, OH (US)

( * ) Notice: Subject to any disclaimer, the term of this patent is extended or adjusted under 35 U.S.C. 154(b) by 123 days.

(21) Appl. No.: 14/542,026

(22) Filed: Nov. 14, 2014

(65) Prior Publication Data

US 2016/0138535 A1 May 19, 2016

(51) Int. Cl.
*F02M 35/104* (2006.01)
*F02M 35/10* (2006.01)

(52) U.S. Cl.
CPC ..... *F02M 35/104* (2013.01); *F02M 35/10045* (2013.01); *F02M 35/10052* (2013.01)

(58) Field of Classification Search
CPC ..... F02M 35/04; F02M 35/10045; F02M 35/10052; F02M 35/10065; F02M 35/100326
USPC ..... 123/184.51
See application file for complete search history.

(56) References Cited

U.S. PATENT DOCUMENTS 6,192,850 B1 * 2/2001 Rutschmann ..... F02B 27/021 123/184.51

OTHER PUBLICATIONS

Jayb, Jun. 16, 2013, FE Power Forums, "Blue Thunder Plenum Modifications", http://fepower.net/simplemachinesforum/index.php?topic=1155.0.*
Joshie225, Slant Six Forum, "Divided or Not", http://www.slantsix.org/forum/viewtopic.php?p=193233&sid=de585481c07cc5c0dd7dd1e3444f992b.*

* cited by examiner

*Primary Examiner* — Lindsay Low
*Assistant Examiner* — Kevin Lathers

(57) ABSTRACT

An intake manifold with a single and dual plane adapter is provided. The intake manifold includes a plenum chamber. The plenum chamber may include a first side, a second side, a bottom portion, and a top portion. The adapter may include a guide rail attached to the plenum chamber and forming a channel in between. A divider is formed to fit within the channel. An actuator is operatively connected to extend and retract the divider within the channel. Therefore, the divider includes an extended position forming a dual chamber within the plenum chamber, and a retracted position forming a single chamber within the plenum chamber.

7 Claims, 4 Drawing Sheets

SINGLE AND DUAL PLENUM ADAPTER

BACKGROUND OF THE INVENTION

The present invention relates to an intake manifold and, more particularly, to an intake manifold with a single and dual plenum adapter.

An intake manifold is the part of an engine that supplies the fuel/air mixture to the cylinders. The primary function of the intake manifold is to evenly distribute the combustion mixture (or just air in a direct injection engine) to each intake port in the cylinder head(s). Even distribution is important to optimize the efficiency and performance of the engine. Currently, intake manifolds either have a single plane or dual plane plenum.

As can be seen, there is a need for a device that may alternate an intake manifold between a single and dual plane plenum.

SUMMARY OF THE INVENTION

In one aspect of the present invention, an intake manifold comprises: a plenum chamber; a guide rail attached to the plenum chamber and forming a channel in between; a divider formed to fit within the channel; and an actuator operatively connected to extend and retract the divider within the channel of the guide rails, thereby the divider comprising an extended position forming a dual chamber within the plenum chamber, and a retracted position forming a single chamber within the plenum chamber.

These and other features, aspects and advantages of the present invention will become better understood with reference to the following drawings, description and claims.

DETAILED DESCRIPTION OF THE INVENTION

Figure 1:
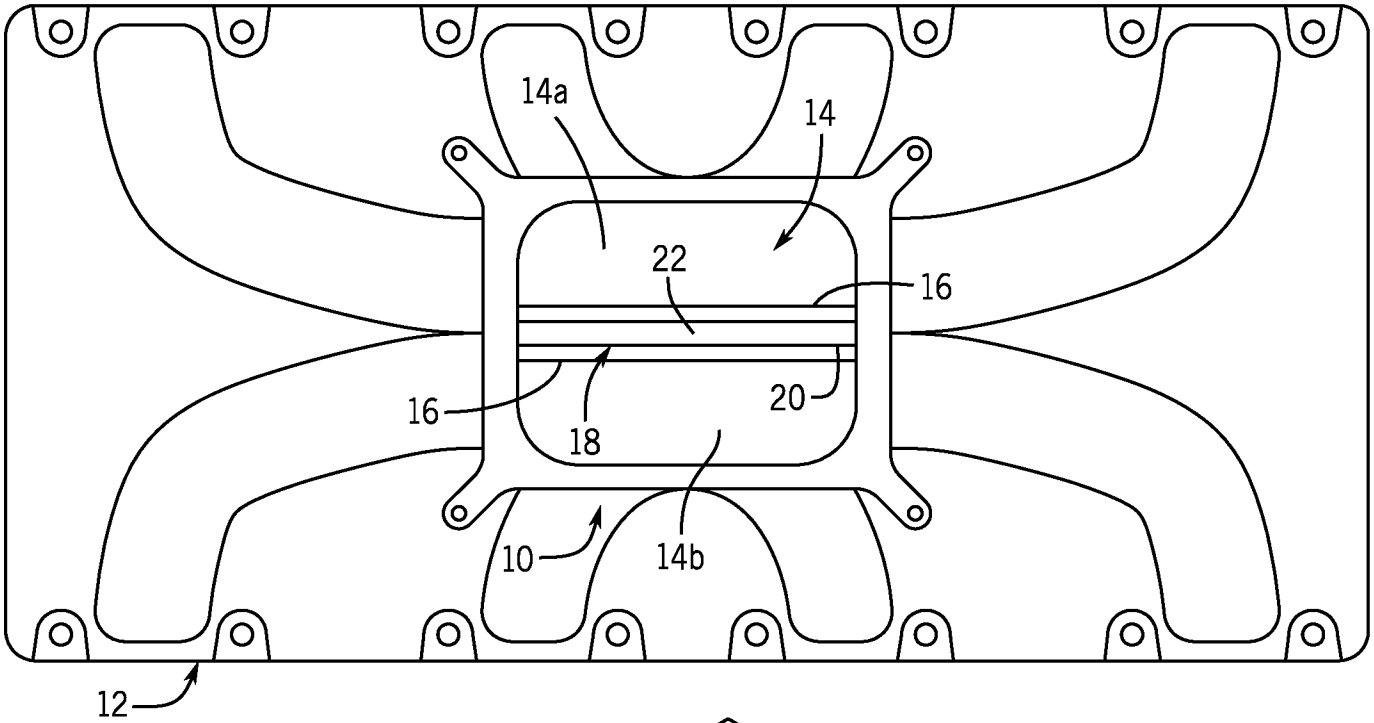
FIG. 1 is a top plan view of the present invention installed in an intake manifold.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes an electro mechanical device for switching single plane manifold to both single and dual plane operation. The present invention effectively takes an existing single plane manifold and adds a movable dividing wall thereby creating a single and dual manifold into one. The present invention does not require a new intake and an existing unit may be modified. The present invention does not require special fuel delivery. The present invention uses electronic means or a vacuum signal for switching operation. In action, an rpm switch or controller receives signal from the motors ignition system and sends the signal to a servomechanism mounted within the aluminum body. The servomechanism moves guides and movable wall up or down within the single plane manifolds plenum area.

Referring to FIGS. 1 through 8, the present invention may include an intake manifold 12 with a single and dual plane adapter 10 installed. The intake manifold 12 includes a plenum chamber 14. The plenum chamber 14 may include a first side, a second side, a bottom portion, and a top portion. The adapter 10 may include a guide rail 16 attached to the plenum chamber 14 and forming a channel in between. A divider 18 is formed to fit within the channel. An actuator 26 is operatively connected to extend and retract the divider 18 within the channel. Therefore, the divider 18 includes an extended position forming a dual chamber within the plenum chamber 14, and a retracted position forming a single chamber within the plenum chamber 14. The dual chamber may include a first half 14*a* and a second half 14*b*.

Figure 2:
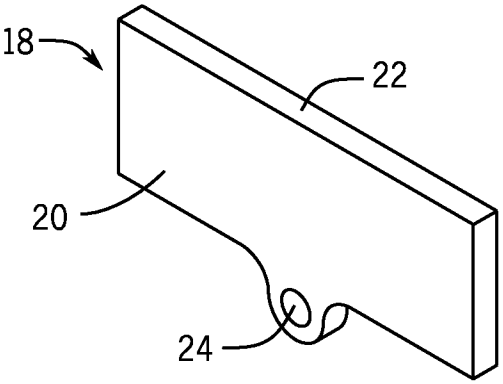
FIG. 2 is a perspective view of the divider component of the present invention.
Figure 3:
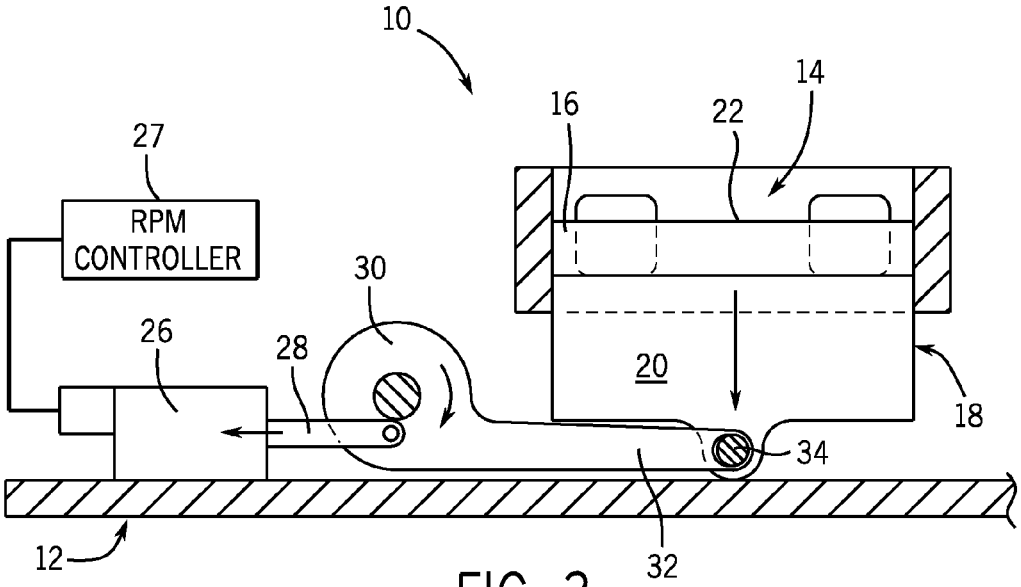
FIG. 3 is a side elevation view with parts shown in section, showing the present invention in a retracted position.
Figure 4:
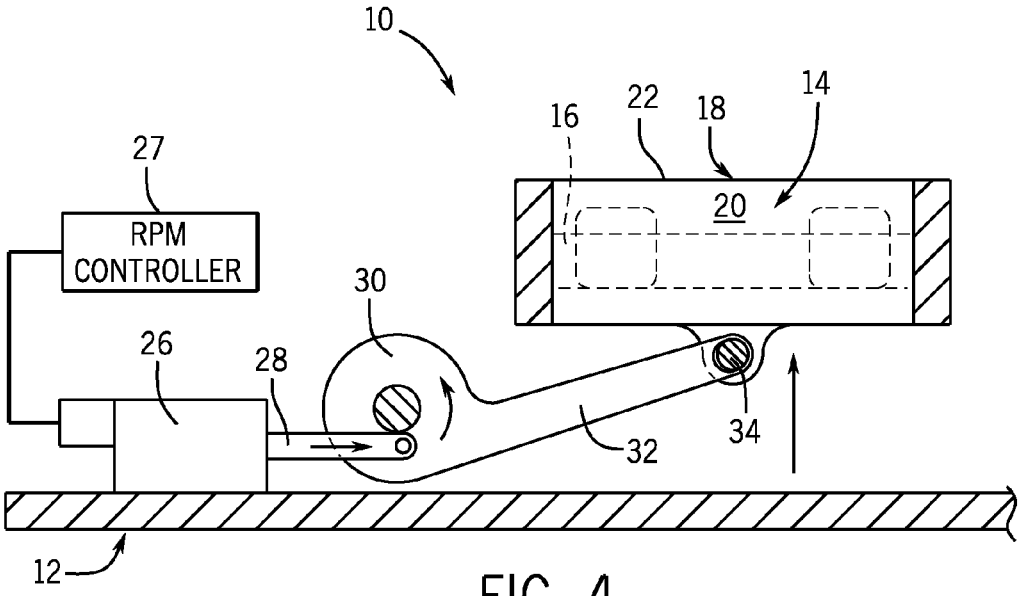
FIG. 4 is a side elevation view, similar to FIG. 3, showing the present invention in an expanded position.

In certain embodiments, the divider 18 extends from the bottom portion to the top portion in the expanded position, and retracts from the top portion to the bottom portion in the retracted position. As illustrated in FIGS. 1 through 3, the divider 18 may be a solid wall having sides 20, a top 22, and an aperture 24. In such embodiments, the present invention may include an actuator arm 28 connected to the actuator 26. The actuator arm 28 may be pivotally connected to an eccentric 30 of an actuation arm 32. The actuation arm 32 may be pivotally connected to the divider 18 by the aperture 24 and pivot pin 34. The actuator 26 may move the actuator arm 28 back and forth, thereby rotating the eccentric 30. By rotating the eccentric 30, the actuation arm 32 may raise and lower the divider 18 from the retracted position to the extended position.

Figure 5:
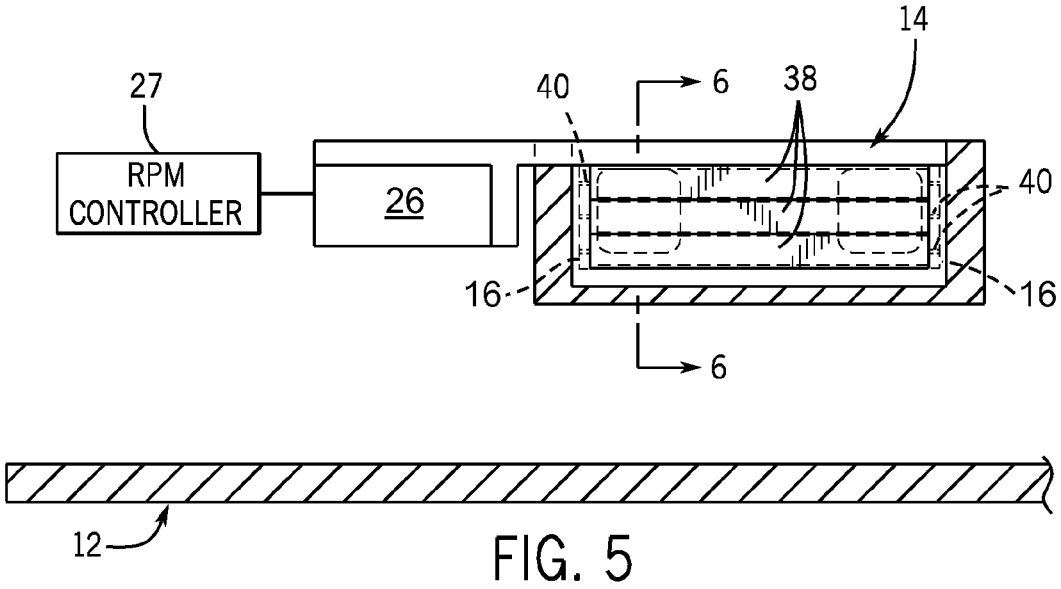
FIG. 5 is a side elevation view with parts shown in section, showing the second embodiment of the present invention in an expanded position.

The divider 18 of the present invention may also be formed as an accordion structure. In such embodiments, the divider 18 may be made of a plurality of horizontal panels 38 pivotally connected together by pivot pins 40. As mentioned above, the divider 18 may extend from the bottom portion to the top portion in the expanded position, and retract from the top portion to the bottom portion in the retracted position. With the accordion structure, the guide rails 16 may be vertical guide rails, as illustrated in FIG. 5. The actuator 26 may raise and lower the accordion structured divider 18 in the expanded position and the retracted position within the vertical guide rails.

Figure 6:
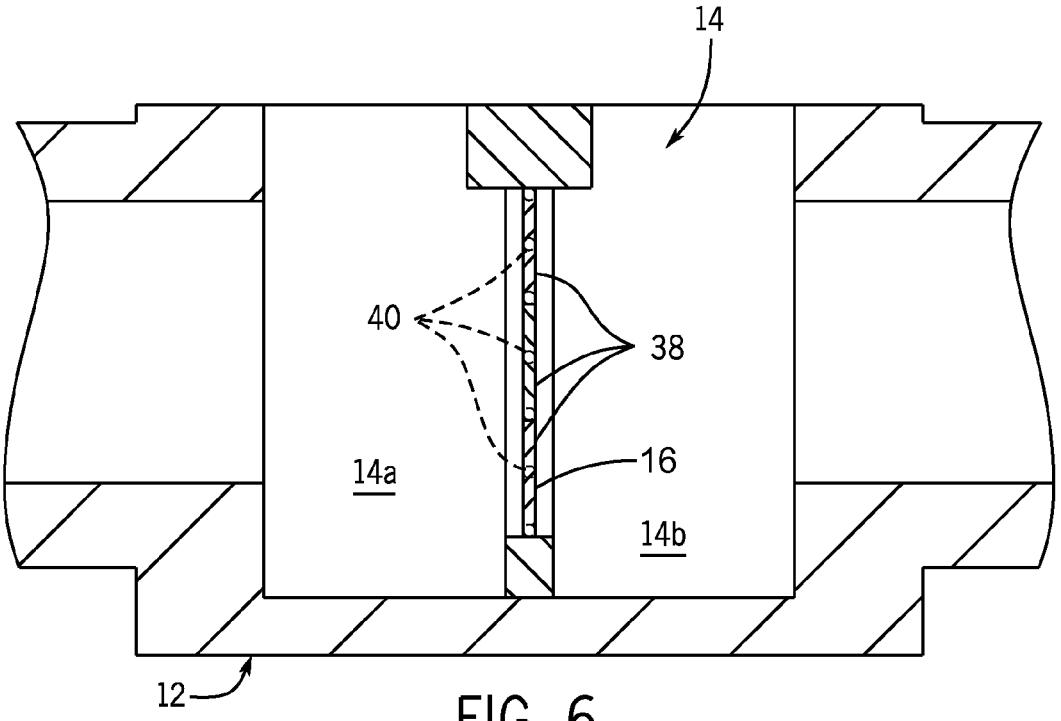
FIG. 6 is a cross-sectional view taken on line 6-6 of FIG. 5.
Figure 7:
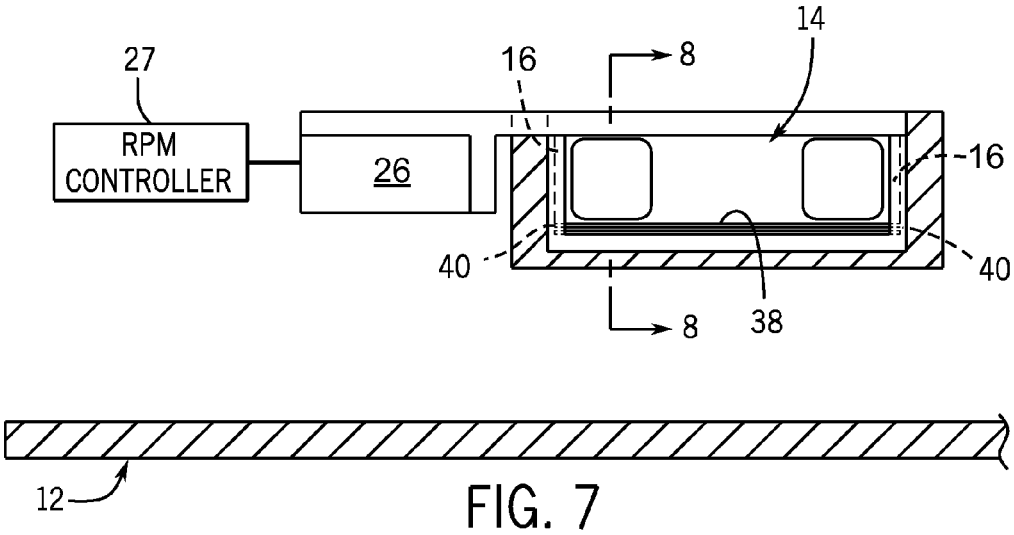
FIG. 7 is a side elevation view with parts shown in section, showing the second embodiment of the present invention in a retracted position.
Figure 8:
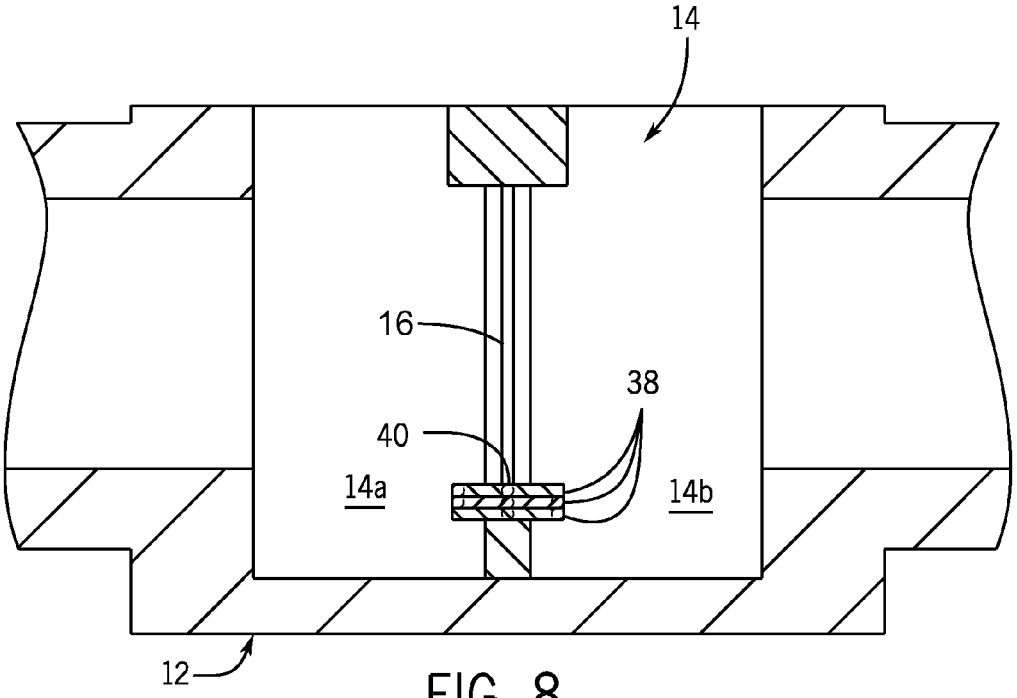
FIG. 8 is a cross-sectional view taken on line 8-8 of FIG. 7.

As illustrated in FIGS. 6 and 8, the divider may extend from the first side to the second side in the expanded position, and retract from the second side to the first side in the retracted position. In such embodiments, the divider 18 of the present invention may include a plurality of vertical panels 38 pivotally connected together by pivot pins 40. In such embodiments, the guide rails 18 may be horizontal guide rails. The actuator 26 may expand the divider 16 from the first side to the second side, and retract the divider 16 from the second side to the first side within the horizontal guide rails.

The actuator 26 of the present invention may be controlled by a revolution per minute (RPM) controller 27 or a vacuum controller. The RPM controller 27 may record the RPMs of the vehicles engine. The RPM controller 27 may then signal the actuator 26 to retract or expand based on the RPMs. In certain embodiments, the divider 18 may expand with a less amount of RPMs to give the engine more torque. The divider 18 may retract with a greater amount of RPMs, to increase fuel efficiency. The controller 27 may be programmed to include a threshold RPM for the expanded and retracted positions.

As mentioned above, the present invention may be an installable adapter 10 to an existing intake manifold 12. A user may simply install the guide rails 16, divider 18, actuator 26 and RPM controller 27 to the existing engine, turning a single plenum into a single/dual plenum.

It should be understood, of course, that the foregoing relates to exemplary embodiments of the invention and that modifications may be made without departing from the spirit and scope of the invention as set forth in the following claims.

What is claimed is:

1. An intake manifold comprising:

a plenum chamber comprising a first side, a second side, a bottom portion and a top portion;

a guide rail attached to the plenum chamber and forming a channel in the plenum chamber;

a divider formed to fit within the channel;

an actuator operatively connected to extend and retract the divider within the channel of the guide rails; and a lever arm operatively connected to the actuator and the divider, wherein the lever arm is rotated by the actuator to move the divider to an extended position forming a dual chamber within the plenum chamber, and a retracted position forming a single chamber within the plenum chamber.

2. The intake manifold of claim 1, wherein the divider extends from the bottom portion to the top portion in the extended position, and retracts from the top portion to the bottom portion in the retracted position.

3. The intake manifold of claim 1, wherein the divider comprises a plurality of panels pivotably attached to one another to form an accordion structure.

4. The intake manifold of claim 1, wherein the divider extends from the first side to the second side in the extended position, and retracts from the second side to the first side in the retracted position.

5. The intake manifold of claim 1, further comprising a revolutions per minute controller operatively connected from an engine of a vehicle to the actuator.

6. The intake manifold of claim 5, wherein an engine revolutions per minute (RPM) which is greater than a threshold RPM, the threshold RPM based on an engine torque, signals the actuator to retract the divider and the engine RPM being less than the threshold RPM signals the actuator to expand the divider.

7. An intake manifold comprising:

a plenum chamber comprising a first side, a second side, a bottom portion and a top portion;

a guide rail attached to the plenum chamber and forming a channel in the plenum chamber;

a divider formed to fit within the channel, wherein the divider comprises a plurality of panels pivotably attached to one another to form an accordion structure; and an actuator operatively connected to extend and retract the divider within the channel of the guide rails, wherein the divider comprises an extended position forming a dual chamber within the plenum chamber, and a retracted position forming a single chamber within the plenum chamber.

* * * * *